US010718590B2

(12) United States Patent
Dorn

(10) Patent No.: US 10,718,590 B2
(45) Date of Patent: Jul. 21, 2020

(54) ADJUSTABLE ARCHERY BOW DRAW STOP

(71) Applicant: Brian Philip Dorn, New Ulm, MN (US)

(72) Inventor: Brian Philip Dorn, New Ulm, MN (US)

( * ) Notice: Subject to any disclaimer, the term of this patent is extended or adjusted under 35 U.S.C. 154(b) by 0 days.

(21) Appl. No.: 16/375,106

(22) Filed: Apr. 4, 2019

(65) Prior Publication Data

US 2019/0316866 A1 Oct. 17, 2019

Related U.S. Application Data

(63) Continuation of application No. 62/657,265, filed on Apr. 13, 2018.

(51) Int. Cl.
*F41B 5/14* (2006.01)
*F41B 5/10* (2006.01)

(52) U.S. Cl.
CPC ..... *F41B 5/1403* (2013.01); *F41B 5/105* (2013.01)

(58) Field of Classification Search
CPC ..... F41B 5/10; F41B 5/105; F41B 5/1403; Y10S 124/90
USPC ..... 124/23.1, 25.6, 86, 900
See application file for complete search history.

(56) References Cited

U.S. PATENT DOCUMENTS 6,082,346 A * 7/2000 Andrews ..... F41B 5/10 124/25.6
6,250,293 B1 * 6/2001 Andrews ..... F41B 5/10 124/25.6
7,082,937 B1 * 8/2006 Land ..... F41B 5/105 124/25.6
7,305,979 B1 * 12/2007 Yehle ..... F41B 5/10 124/25.6
7,997,259 B2 * 8/2011 Wilson ..... F41B 5/105 124/25.6
8,281,774 B2 * 10/2012 Grace ..... F41B 5/105 124/25.6
8,544,456 B2 * 10/2013 Grace ..... F41B 5/10 124/23.1
8,960,173 B2 * 2/2015 Okupniak ..... F41B 5/10 124/23.1
9,097,486 B1 * 8/2015 Huang ..... F41B 5/105
9,121,658 B1 * 9/2015 Darlington ..... F41B 5/123
9,261,321 B2 * 2/2016 Yi ..... F41B 5/105
9,335,114 B2 * 5/2016 Yi ..... F41B 5/105
9,347,730 B2 * 5/2016 Obteshka ..... F41B 5/105
9,441,907 B1 * 9/2016 Obteshka ..... F41B 5/105
9,506,714 B1 * 11/2016 Eacker ..... F41B 5/105
9,581,407 B2 * 2/2017 Yi ..... F41B 5/105
9,739,562 B1 * 8/2017 Obteshka ..... F41B 5/105
10,260,833 B1 * 4/2019 Rinker ..... F41B 5/105
2006/0174859 A1 * 8/2006 Andrews ..... F41B 5/10 124/25.6
2012/0000451 A1 * 1/2012 Grace ..... F41B 5/10 124/25.6
2013/0068206 A1 * 3/2013 Langley ..... F41B 5/105 124/25.6
2017/0115088 A1 * 4/2017 Grace ..... F41B 5/105
2018/0195829 A1 * 7/2018 Derus ..... F41B 5/105

* cited by examiner

*Primary Examiner* — Alexander R Niconovich

(57) ABSTRACT

A draw stop for a compound bow having a plurality of radii on perimeter with one common axis, axis is also coincident with mounting axis. The draw stop can be orientated in multiple positions to vary the draw length of a bow. No orientation pins or lugs are needed to achieve this.

18 Claims, 4 Drawing Sheets

ADJUSTABLE ARCHERY BOW DRAW STOP

BACKGROUND

The field of the invention generally relates to draw stops attached directly or indirectly to a limb, cam, wheel, pulley or module of a compound bow. US patent classification F4165/1403 details of bows, and F4165/105 Cams or pullies for compound bows.

Draw stops are a common device used to limit the draw length, let-off, and valley, herein referred to as draw length, of a compound bow. Some cams, pullies, wheels or modules, herein referred to as cams, have a series of holes in it to mount a draw stop. The stop may hit a cable, string, limb, or other part of the bow, herein referred to as abutment surface, when drawn back resulting in the cam stopping also stopping the ability to draw the bowstring. The holes in the cam generally coordinate with specific lengths typically in one half inch increments. Mounting holes may also be in a module or other bracket attached to the cam. The draw stops are typically cylindrical in shape with the mounting axis coincident with the functional surface of the stop's axis. This configuration typically limits the draw lengths to one half inch increments.

There is a desire among archers to fine tune draw length closer than one half inch increments. There are several ways currently of doing this with the draw stops. The diameter of the cylindrical surface of the stop can be increased or decreased. This would require many different stops to cover the range of draw length.

Another way to limit is to adjust the abutment surface by applying material to it. This is not easily done and lacks consistency.

Another method is to use a stop with flats that are different lengths from the axis of the stop or a simple eccentric. The stop can be oriented differently to the abutment surface stopping the cam rotation at different lengths. This method requires the stop surface to be precisely aligned with the abutment surface, if it is not the resulting force will not be applied radially to the axis of the stop and it will result loosening or tightening the stop. Another problem from incorrect alignment is the length will not be consistent from one cam to another. One solution used for this problem is to use an orientation pin or orientation lug and pocket combination on the stop and cam.

The attempted solutions lack simplicity and versatility. They will either require many stops, precise alignment, or additional costly machining to the cam and stop to be versatile.

BRIEF SUMMARY OF THE INVENTION

The invention is a simple draw stop with a plurality of radii having one common axis.

One of the inventions object is to allow a plurality of draw stop options in one embodiment. The different radii will offer this. Another object is no orientation pin or orientation lug pocket combination is required to position the stop. This will allow said stop to be retrofitted to most cams using this method and obviously could be incorporated in the manufacturing of new bows. Another object is force is applied to the common axis of the stop regardless of the orientation of the stop, this will prevent the stop from loosening or tightening under force. Another object the stop does not need to be precisely orientated to work if the abutment contacts the stop on any part of one of the radii, this will allow for easy installation and adjustment.

DETAILED DESCRIPTION OF INVENTION

Figure 1:
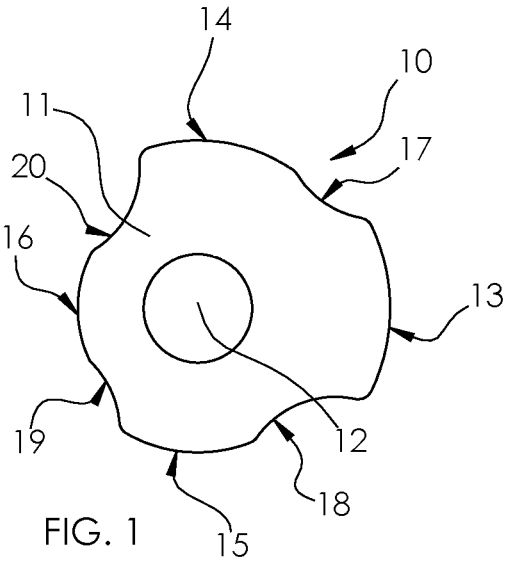
FIG. 1 is a top plan view of the first embodiment of the adjustable archery bow draw stop.
Figure 2:
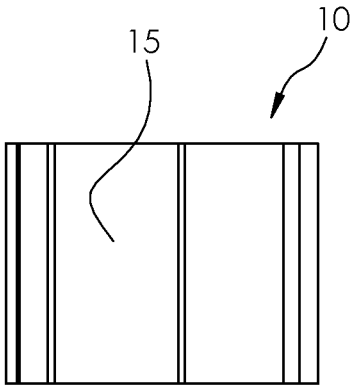
FIG. 2 is a front elevation view thereof.
Figure 3:
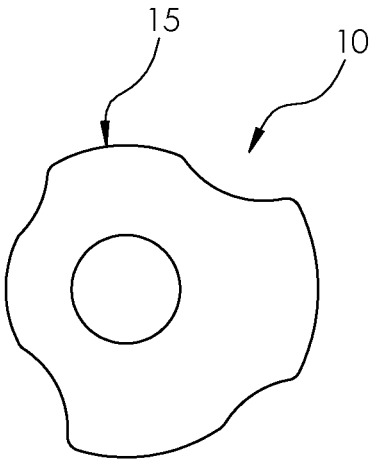
FIG. 3 is a bottom plan view thereof.
Figure 4:
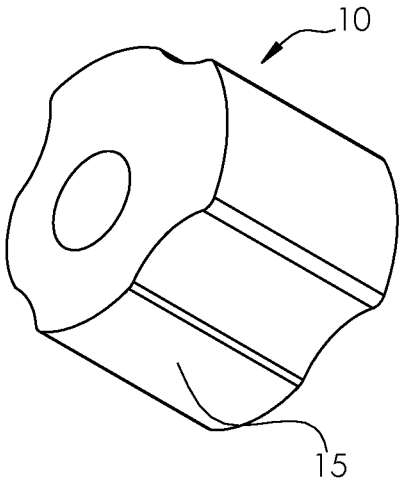
FIG. 4 is a top, right, and front isometric view thereof.
Figure 5:
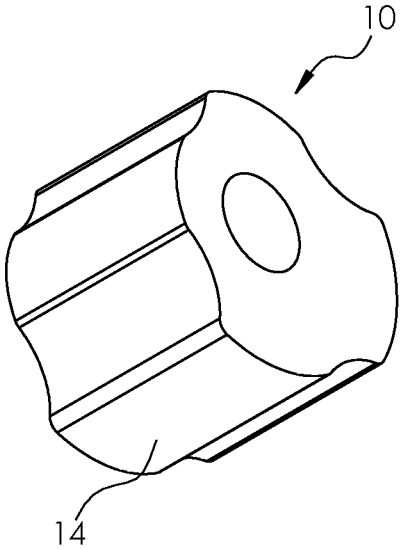
FIG. 5 is a bottom, left, and back isometric view thereof.
Figure 6:
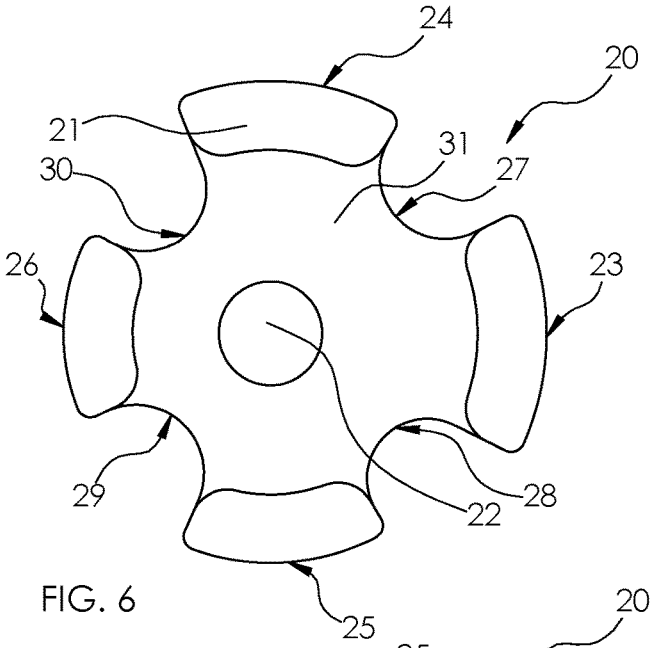
FIG. 6 is a top plan view of a second embodiment thereof.
Figure 9:
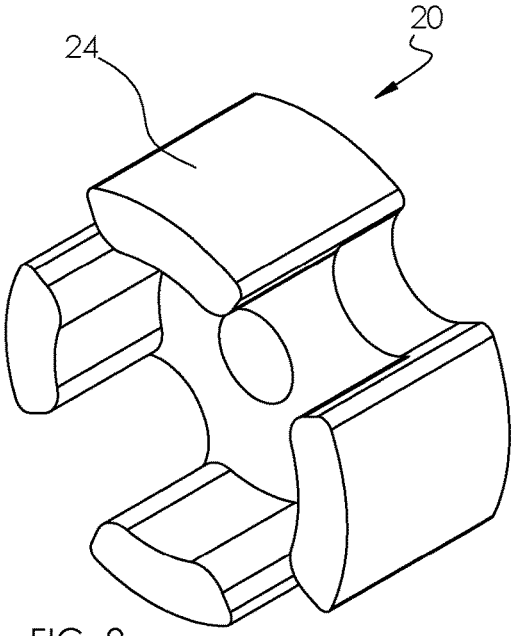
FIG. 9 is a top, right, and back isometric view of embodiment in FIG. 6.
Figure 7:
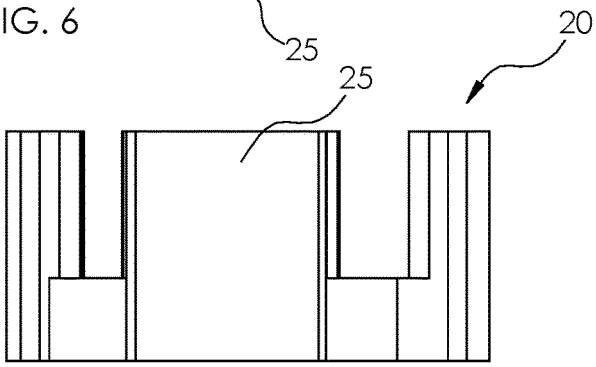
FIG. 7 is a front elevation view of embodiment in FIG. 6.
Figure 8:
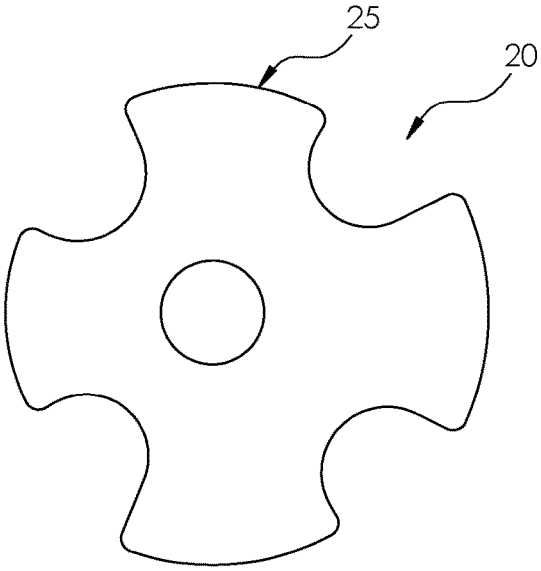
FIG. 8 is a bottom plan view of embodiment in FIG. 6.
Figure 10:
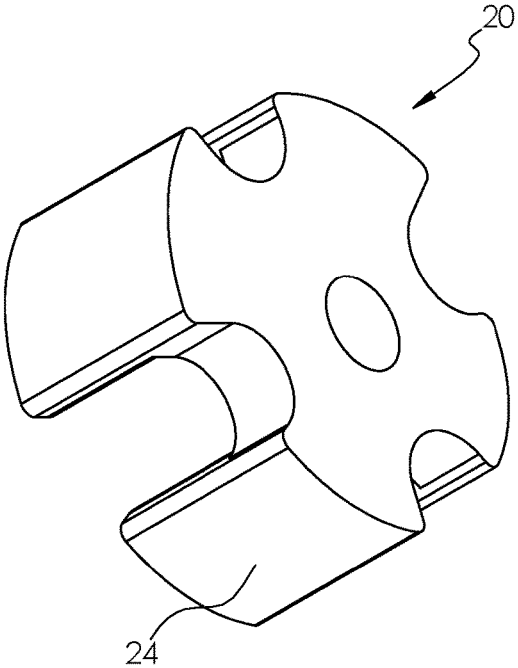
FIG. 10 is a bottom, right, and front isometric view of embodiment in FIG. 6.
Figure 11:
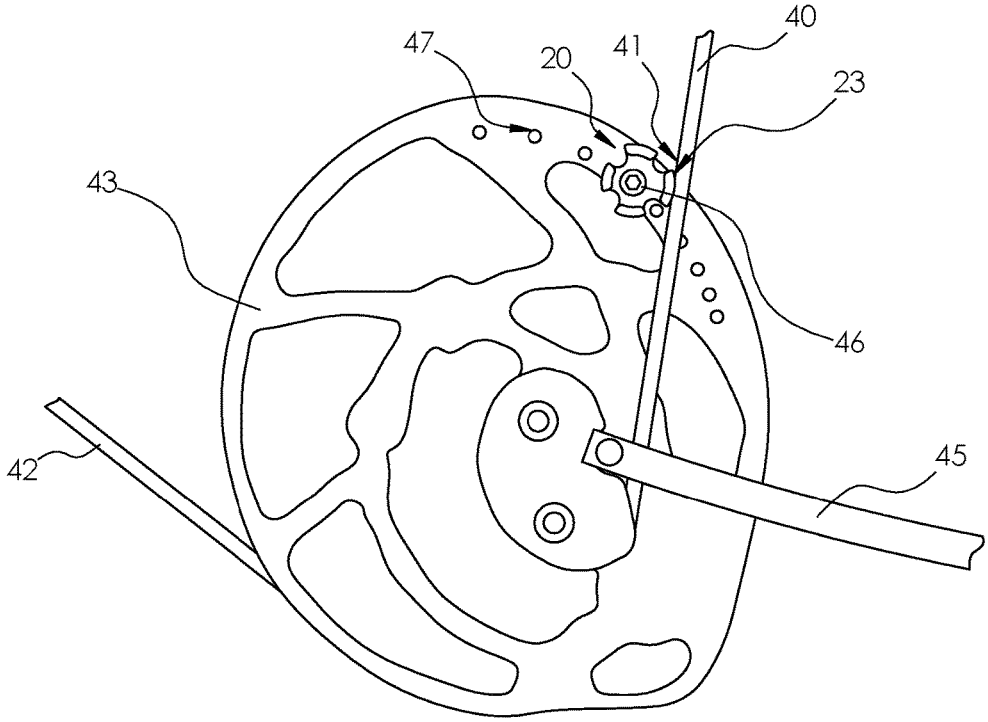
FIG. 11 is a top plan view of embodiment in FIG. 6 wherein thereof is being used.

The adjustable archery bow draw stop of the present invention is shown in several embodiments 10 and 20 although its intended function is the same the preferred embodiment 20 is represented in FIG. 6. The function of said stop 20 as shown in FIG. 11, is the radius face 23 will contact the abutment face 41 of the bow cable 40 and stop bow cam 43 from rotating this will also stop the bowstring 42 from feeding off said bow cam 43. This action will prevent the bow from being drawn back any farther. By simply rotating the said stop 20 to a different radius face 24, 25, 26 the archer can adjust how much said bow cam 43 rotates before it stops giving the archer the ability to control the draw length of the said bow.

Referring to FIGS. 1, 2, 3, 4, and 5 the said stops 10, general shape is cylindrical. The perimeter shape of said stop 10 would have a plurality or radius faces 13, 14, 15, 16 each one having a different radius. All the radii of said faces 13, 14, 15, 16 would have one common axis 12. The said radius faces 13, 14, 15, 16 are functional throughout the complete arc degrees of face. Nonfunctional on the said perimeter may be flats tangent to the smallest of two adjoining said radius faces 14, 15, 16 or may be relieved farther as shown 17, 18, 19, 20. There is no limit to the number of said radius faces 13, 14, 15, 16 on the perimeter, the amount will affect the arc degrees of said radius faces 13, 14, 15, 16, in the preferred embodiment this would be forty-five degrees. The top and bottom of said stop 10 are flat perpendicular to said axis 12. Said radius axis 12 will also be coincident with mounting axis 12. Said mounting axis 12 could be a hole to accept a screw, a threaded hole, a round boss, a shaped boss for orientation or any other means of common connection to said bow cam 43. The body 11 could also include an orientation hole or pin relative to mounting axis 12 and said radius faces 13, 14, 15, 16. The body 11 of the preferred embodiment would be of a rigid material however it could be made of a resilient material or combination of materials. This would affect the stiffness of the stop and reduce noise.

Referring to FIGS. 6, 7, 8, 9, and 10 the said stop 20 is representing the preferred embodiment. The body 21 has a face 31 that has been relieved to reduce weight of said stop 20. The relief cuts 27, 28, 29, 30 are deeper to also reduce weight.

Figure 12:
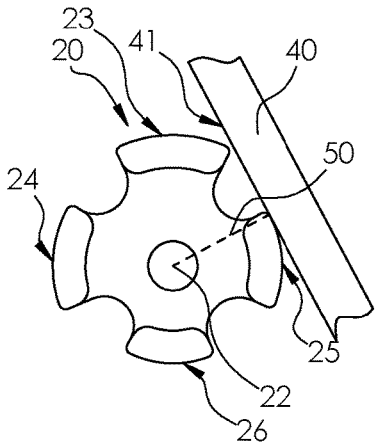
FIG. 12 is a top plan view of embodiment in FIG. 6 wherein thereof is being used.
Figure 13:
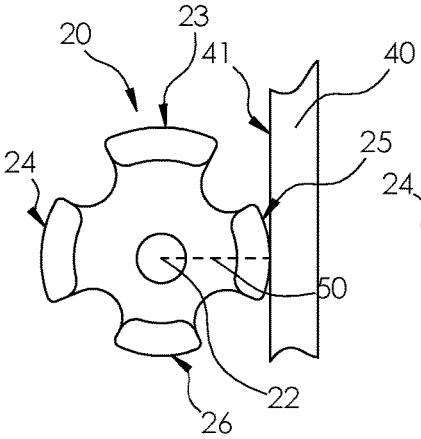
FIG. 13 is a top plan view of embodiment in FIG. 6 wherein thereof is being used.
Figure 14:
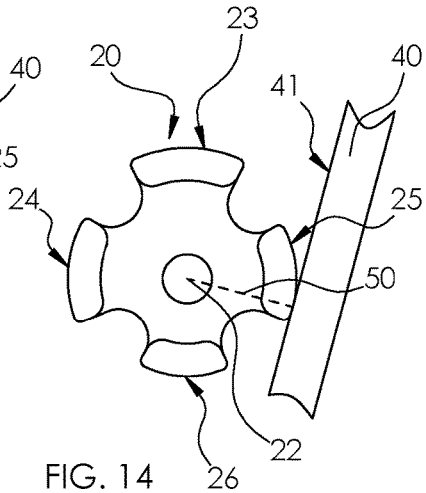
FIG. 14 is a top plan view of embodiment in FIG. 6 wherein thereof is being used.

Referring to FIGS. 12, 13 and 14 illustrates how the said stop 20 does not need to be accurately set in orientation to abutment face 41 of bow cable 40 to achieve the same results. In all three FIGS. 12, 13, and 14 the distance 50 from said abutment face 41 to stop axis 22 is equal, stopping the bow cam 43 in the same position. Additionally, the resulting force of the action is radially applied to said mounting axis 22 this will prevent the mounting screw 46 from turning under load. If the stop was a simple eccentric orientation would be critical also the resulting force would not be radially applied to said mounting screw 46 tightening or loosening said mounting screw. Said stop 20 can be rotated to any of the radius faces 23, 24, 25, 26 that contact the abutment face 41 resulting in different draw lengths. FIG. 12. Also illustrates the need for the flat or said relief 28 to give the maximum width of said radius face 25 since this is the smaller of the two radius faces 25, 23 said relief 28 need to be at least tangent.

Figure 15:
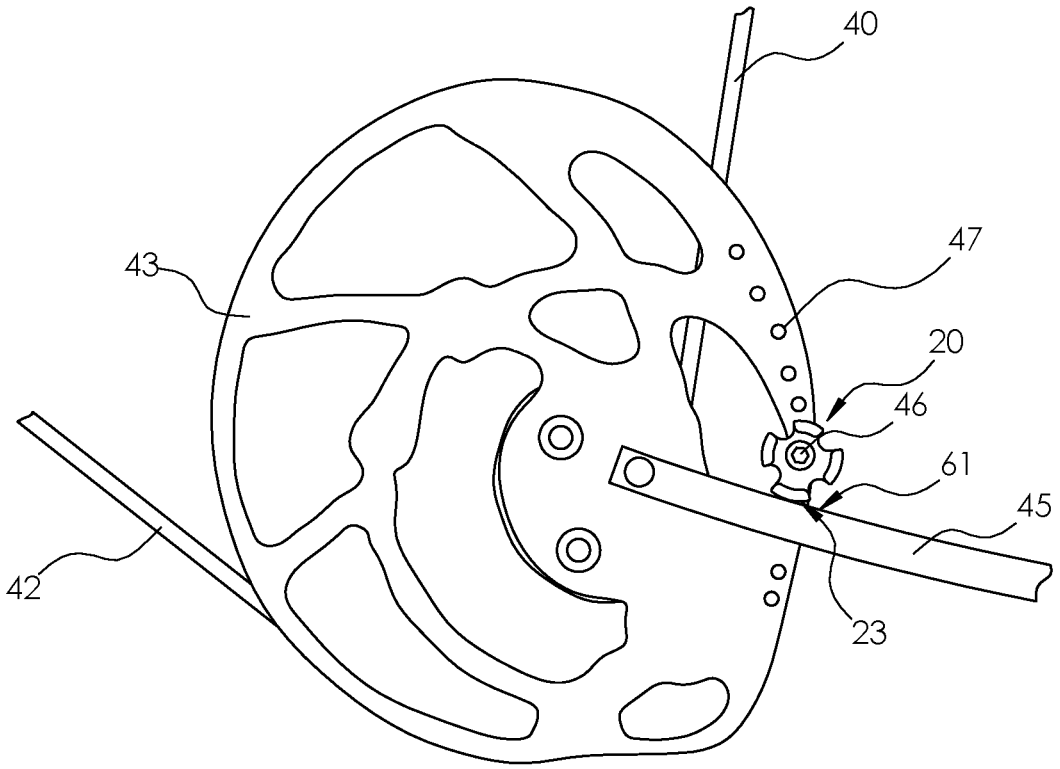
FIG. 15 is a top plan view of embodiment in FIG. 6 wherein thereof is being used.
Figure 16:
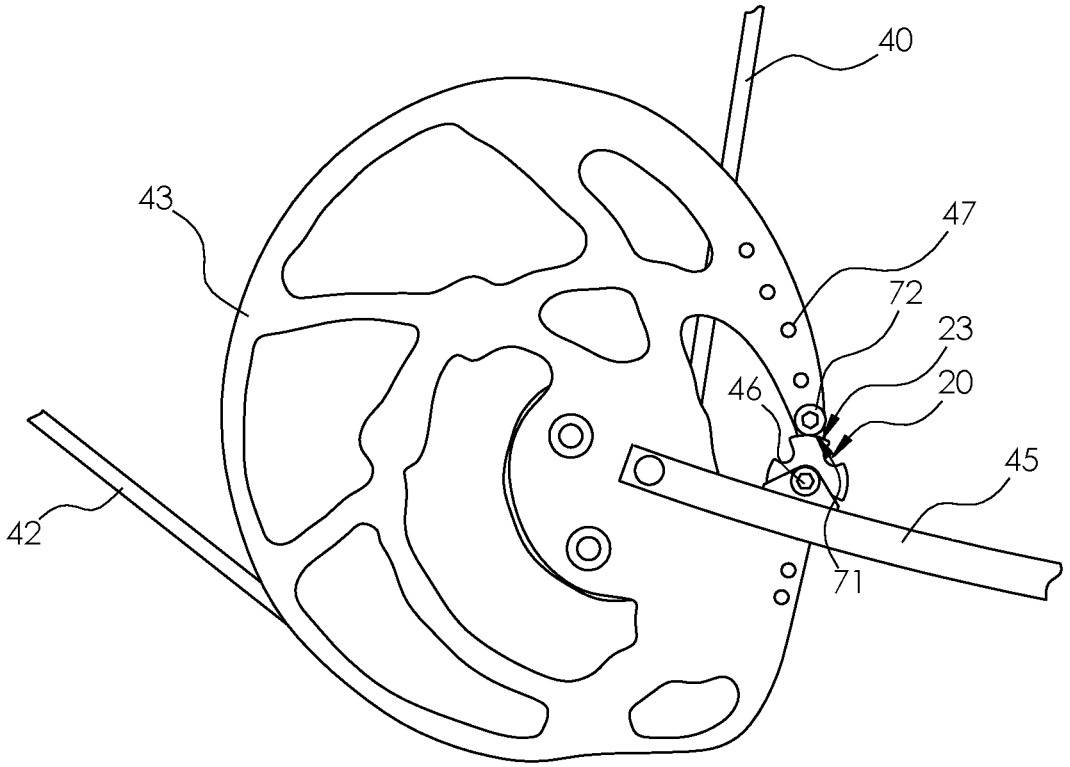
FIG. 16 is a bottom plan view of embodiment in FIG. 6 wherein thereof is being used.

FIGS. 11, 15, and 16 illustrate said draw stop 20 mounted on typical compound bows at full draw. In FIG. 11 the said stop 20 is mounted to the said bow cam 43 with said fastener 46. There is a series of holes 47 in said cam 43 said holes 47 are generally for one half inch adjustments of draw length. By rotating the said stop 20 the archer can obtain draw lengths within said one half inch. Said stop 20 will contact the said abutment face 41 of said bow cable 40 to stop the draw cycle. In FIG. 15 said draw stop 20 is attached to the said cam 43 using said fastener 46 in one of the said mounting holes 47. Said stop 20 contacts abutment face 61 of bow limb 45 to stop the draw cycle. In FIG. 16 the said stop is attached to said bow limb 45 using said fastener 46. A stop peg 72 is fastened in one of the said mounting holes 47. Said cam 43 stops rotation when said stop peg 72 abutment surface 71 contacts the said draw stop 20. These are some examples of the application of the said stop 20.

What is claimed is as follows:

1. A draw stop for a compound bow comprising:

a body of general right cylindrical shape, wherein a base shape of said right cylindrical shape has a plurality of concentric circular arcs of different radii, wherein an axis is formed from a center of said concentric circular arcs and an altitude of said right cylindrical shape, wherein a mounting axis is coaxial to said axis, wherein said mounting axis is defined as an imaginary line about which said draw stop rotates as mounted in a different angular position relative to said base concentric circular arcs, wherein said mounted is defined as affixing said draw stop to a member of said compound bow, wherein said mounting axis is parallel to a rotational axis of a cam, wheel or pulley of said compound bow, wherein said draw stop will contact an abutment surface on a member of said compound bow when drawn stopping rotation of said cam, wheel or pulley.

2. The draw stop of claim 1 wherein said draw stop has an orientation pin relative to said mounting axis and said base concentric circular arcs.

3. The draw stop of claim 1 wherein said draw stop has an orientation hole relative to said mounting axis and said base concentric circular arcs.

4. The draw stop of claim 1 wherein said draw stop has a plurality of orientation holes relative to said mounting axis and said base concentric circular arcs.

5. The draw stop of claim 1 wherein said draw stop has an orientation lug relative to said mounting axis and said base concentric circular arcs.

6. The draw stop of claim 1 wherein said draw stop has an orientation pocket relative to said mounting axis and said base concentric circular arcs.

7. The draw stop of claim 1 wherein said draw stop is attached directly to said cam, wheel, or pulley.

8. The draw stop of claim 1 wherein said draw stop is attached indirectly to said cam, wheel, or pulley.

9. The draw stop of claim 1 wherein said base shape has two circular arcs.

10. The draw stop of claim 1 wherein said base shape has three circular arcs.

11. The draw stop of claim 1 wherein said base shape has four circular arcs.

12. The draw stop of claim 1 wherein said draw stop body is made of a resilient material.

13. The draw stop of claim 1 wherein said draw stop body has a resilient surface applied.

14. The draw stop of claim 1 wherein said draw stop said mounting axis is female threads.

15. The draw stop of claim 1 wherein said draw stop said mounting axis is male threads.

16. The draw stop of claim 1 wherein said draw stop said mounting axis is a hole.

17. The draw stop of claim 1 wherein said draw stop said mounting axis is a cylindrical lug.

18. The draw stop of claim 1 wherein said draw stop said mounting axis is a cylindrical counter bore.

* * * * *